United States Patent [19]

Nichols

[11] Patent Number: 4,639,036

[45] Date of Patent: Jan. 27, 1987

[54] SUN SHADE APPARATUS FOR A LOUNGE CHAIR

[76] Inventor: James O. Nichols, 1805 Olive La., Plymouth, Minn. 55447

[21] Appl. No.: 735,398

[22] Filed: May 17, 1985

Related U.S. Application Data

[63] Continuation-in-part of Ser. No. 543,751, Oct. 20, 1983, abandoned.

[51] Int. Cl.[4] ..... A47C 7/62

[52] U.S. Cl. ..... 297/184; 248/231.4; 297/173

[58] Field of Search ..... 297/184, 191, 29, 154, 297/173, 153; 24/522, 523, 524; 248/231.4; 403/385

[56] References Cited

U.S. PATENT DOCUMENTS

| | | | |
|---|---|---|---|
| 187,143 | 2/1877 | Hunt . | |
| 353,716 | 12/1886 | Spencer . | |
| 798,823 | 9/1905 | McMahon . | |
| 1,187,226 | 6/1916 | Anderson . | |
| 2,207,892 | 7/1940 | Mullaney | 24/523 X |
| 2,319,377 | 5/1943 | Wallace et al. | 24/523 |
| 2,466,909 | 4/1949 | Periman | 24/523 X |
| 2,747,653 | 5/1956 | Obradovich . | |
| 2,752,929 | 7/1956 | Berger . | |
| 2,815,799 | 12/1957 | Lovico | 297/320 X |
| 3,015,467 | 1/1962 | Vieaux . | |
| 3,050,280 | 8/1962 | Regan . | |
| 3,162,206 | 12/1964 | Betts . | |
| 3,243,230 | 3/1966 | Otto . | |
| 3,738,703 | 6/1973 | Kunimatu . | |
| 4,030,748 | 6/1977 | Brock . | |
| 4,093,305 | 6/1978 | Staroste et al. . | |
| 4,201,416 | 5/1980 | Vanderminden . | |
| 4,300,798 | 11/1981 | Musgrove et al. . | |

FOREIGN PATENT DOCUMENTS

| | | | |
|---|---|---|---|
| 93591 | 6/1962 | Denmark | 297/184 |
| 765091 | 3/1955 | Fed. Rep. of Germany | 24/522 |
| 1171778 | 1/1959 | France | 297/184 |

*Primary Examiner*—James T. McCall
*Assistant Examiner*—Mark W. Binder
*Attorney, Agent, or Firm*—Merchant, Gould, Smith, Edell, Welter & Schmidt

[57] ABSTRACT

The present invention is directed to sun shade apparatus for a chair or similar structure. The apparatus includes adjustment mechanisms for orienting the canopy sheet with respect to the chair for shade, for use as a tray or for stowage. The apparatus is easily attached to the chair with clamping mechanisms which are attached to the legs of a frame member.

6 Claims, 12 Drawing Figures

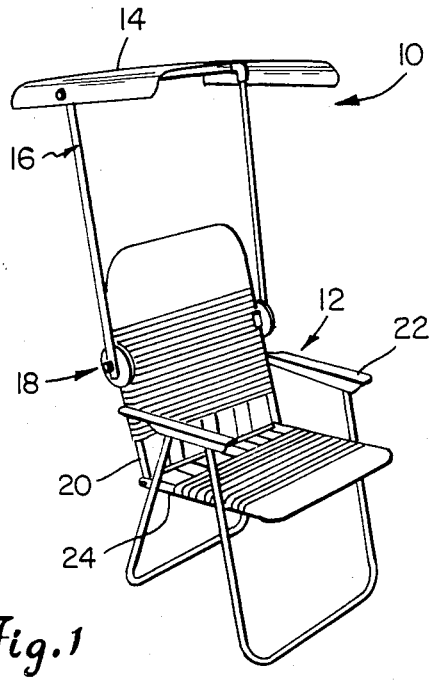
Fig. 1
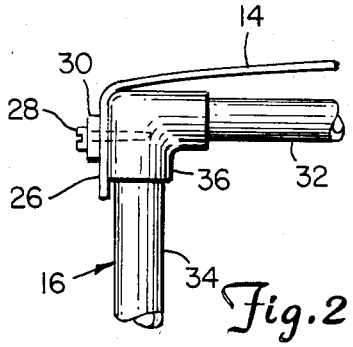
Fig. 2
Fig. 3
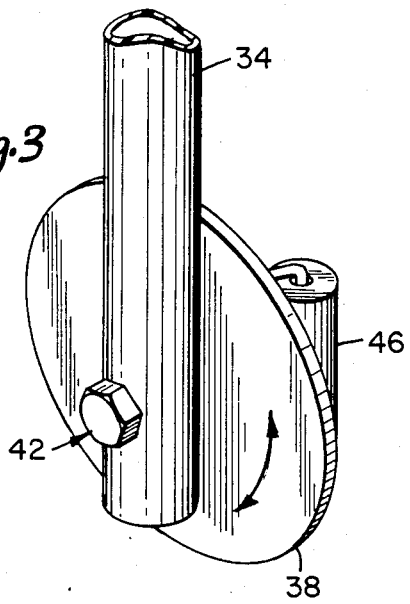
Fig. 4
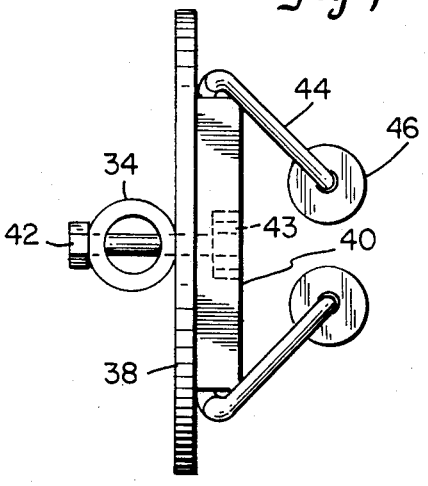

SUN SHADE APPARATUS FOR A LOUNGE CHAIR

This is a Continuation-In-Part of Ser. No. 543,751, filed Oct. 20, 1983, now abandoned.

FIELD OF THE INVENTION

The present invention is directed to a sun shade apparatus for a lounge chair and, more particularly, to an inexpensive apparatus which is simply operable thereby making it readily attractive to the buying public in contrast to present devices which have not been widely accepted.

BACKGROUND OF THE INVENTION

Lounge chairs of various types are well known. Chaise lounge chairs are commonly available in three sections, two of which are adjustable for supporting the legs and the back at various positions. Most other chairs are unadjustable, but are commonly foldable for easy movement from place to place. Most such chairs have a tubular, aluminum frame with wood or aluminum armrests. The seat and back portions usually have a plurality of straps made from various materials extending between side frame pieces.

Umbrella or canopy devices for lounge chairs are also known. Present devices, however, tend to be relatively complex and, consequently, somewhat cumbersome to use and more expensive than the buying public is willing to accept. For example, a canopy is shown in U.S. Pat. No. 2,752,929 having a material covered frame. Three nut and bolt combinations fasten the canopy frame and a pair of bearing pieces to the chair frame on both sides of the chair frame. Installation is, thus, relatively permanent. Additionally, the canopy is adjustable at only one location and, consequently, perhaps not sufficiently versatile to offer shade protection for a variety of situations.

A later patent, U.S. Pat. No. 3,050,280, shows an umbrella which is supported by an angular post from the top frame member of the chair. A chair holding mechanism provides positive adjustability. The holding mechanism includes a holder member and retainer member. Each has a pair of clamp elements hinged together at one end. As the clamp elements are placed on or about the chair frame, a screw is tightened to achieve appropriate clamping. Both the holder member and the retainer member have complimentary radial grooves on facing surfaces so that as they are moved into engagement and tightened the post holding the umbrella is given a positive angular orientation. This device is not quite as permanent as the previously mentioned device, but it is rather complex in that two separate assemblies must be installed and properly oriented before the umbrella member can even be implaced. Also, each of the holder and retainer members are rather small and are separate from the umbrella so that either could easily be lost while transporting.

A more recent example of a sun protector is disclosed in U.S. Pat. No. 4,093,035. The device shown therein has simplified the attachment mechanism between the sun shade and the chair to a simple press-on clamp, however, the frame for the sun shade and the adjustment mechanism for it is, as with the other art, much more complex than the public is willing to accept. The frame for the sun shade includes three inverted, U-shaped members. The three frame members have mounting ears at the ends which are fastened together to the clamp by a clamping bolt. To adjust the device, the bolt must be loosened while each of the frame members are oriented. The bolt must then be retightened while maintaining the desired orientation for the three frame members. Such operation is simply too complex for a person intent on relaxing.

SUMMARY OF THE INVENTION

The present invention is preferably made primarily from synthetic materials which exhibit low frictional characteristics with respect to a pair of elements sliding relative to one another and, as a result, may be made more simply than present devices and more inexpensively. The present invention is attachable with a pair of press-on clamps and is adjustable by a simple grasping of the apparatus frame member and moving to a proper orientation and a similar grasping of the shade member and moving to a proper orientation. Thus, the present invention is easily adjustable and, therefore, more versatile and usable in the variety of situations encountered.

The present sun shade apparatus for a lounge chair includes a plastic sheet screwed to the side legs of a single inverted, U-shaped poly-vinyl chloride (PVC) tubular frame. The shade member is adjustable by simply rotating it about the screws. The frame member is attached at the lower ends of its legs to clamping devices. The tubular ends are fastened with nut and bolt combinations to a retainer plate with a bearing plate between the retainer plate and the tubular end. Yieldable clamp members are retained between the retainer plate and the bearing plate. The yieldable clamp members are simply separable to receive the tubular frame member of a chair and have a sufficient spring constant so as to thereafter apply sufficient force against that member to clamp it to the retainer plate thereby holding the sun shade assembly to the chair frame. The lower portion of the sun shade frame members are adjustable by simply rotating them about the aligned bolts of the two clamping devices. The bearing plate is preferably made from a synthetic material, such as nylon, delron or a plastic and, consequently, even though the frame member and the bearing member are tightly fastened together, they are forceably rotatable with respect to one another.

In an alternate embodiment, the clamping devices are comprised of first and second clamp elements which move linearly with respect to one another and are biased toward a clamped position. The clamp elements of each clamping device are attached by a single bolt and a threaded knob to the tubular frame of the sun shade apparatus. A bearing plate is located between the frame member and the clamp elements. The frame member may be pivoted or rotated about the bolt and with respect to the clamp elements, and furthermore, the tubular frame and the shade member may be moved between a first position which provides shade for the chair, a second position wherein the flat shade member may be used as a tray located near the lap of a person sitting in the chair, and a stowed position wherein the flat shade member is rotated approximately three quarters of the way around the chair from the tray position to a stowed location behind the chair wherein the flat shade member is approximately parallel with the back of the chair. It is noted that these three uses are particularly appropriate for all types of chairs and perhaps even other structures, especially wheel chairs.

Thus, a sun shade apparatus which is readily transportable, yet simply usable with great versatility has finally been discovered. In view of available devices, the simplicity of the present invention is evidence of its unobviousness.

These advantages and other objects of the present invention are more fully described in the detailed description hereinafter with reference to the following drawings.

BRIEF DESCRIPTION OF THE DRAWINGS

FIG. 1 shows a perspective view of a sun shade apparatus in accordance with the present invention is attached to a representative lounge chair;

FIG. 2 is a partial, front view of an attachment of the shade member to the frame member;

FIG. 3 is a perspective view of an attachment of a leg of the apparatus frame member to the clamping mechanism;

FIG. 4 is a partial cross-sectional view looking downwardly at the clamping mechanism of FIG. 3;

DETAILED DESCRIPTION OF THE PREFERRED EMBODIMENT

Figure 5:
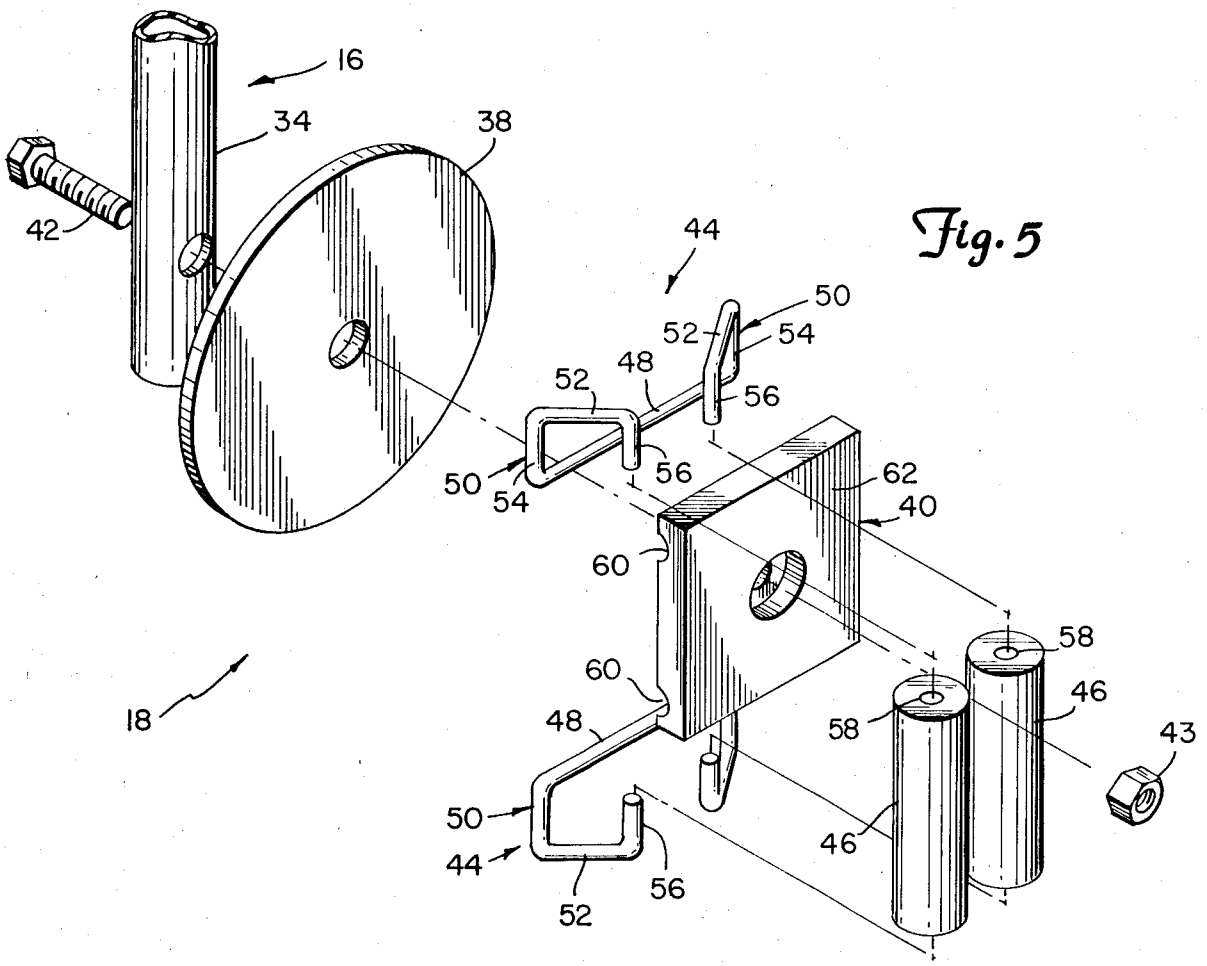
FIG. 5 is an exploded, perspective view of the clamping mechanism of FIGS. 3–4.

Referring now to the drawings wherein like reference numerals designate identical parts throughout the corresponding views, and more particularly to FIG. 1, a sun shade apparatus in accordance with the present invention is designated generally by the number 10. Sun shade apparatus 10 is shown attached to a representative lounge chair 12. Apparatus 10 includes a shade member 14 attached to a single frame member 16 having a pair of adjustable, clamp mechanisms 18 at each of its lower ends. Chair 12 may be any of a variety of chairs which have a side frame member 20 along the back, an arm rest 22 generally parallel to a seat portion, or a side frame member 24 along the side of the seat portin of the chair. Clamp mechanisms 18 may then be easily attached to either the frame members 20 or the arm rests 22. If arm rests 22 are not present, then clamp mechanisms 18 may be easily attached to frame members 24. The indicated elements are, of course, simply indicative of the type to which assembly 10 may be attached. The innovative user will find a number of other ways to attach the invention to the chair of their choice.

Shade member 14 is preferably a single sheet of semiflexible material which has been formed to have downwardly extending portions 26 along opposite side edges. Sheet 14 is preferably made from a plastic material. The semirigid nature of the material makes it unnecessary to support member 14 anywhere except at the axial attachment points.

Shade member 14 is attached at each side of frame member 16 with a single screw 28 passing through a washer 30 and an opening in downwardly extending portion 26. A pair of screws 28 are used so that one may be located on opposite sides of shade member 14 along a given axis. Preferably, shade member 14 is approximately centrally attached with respect to its front and rear edges to frame member 16. Also, it is preferable if washers 30 are a synthetic material. In that way, even through screws 28 are rather tightly fastened, a low coefficent of friction exists between shade member 14 and washers 30 and frame member 16 so that shade member 14 may be relatively easily forceably rotated. It is understood, too, that shade member 14 may have other configurations, including, for example, one or more transverse bends between its front and rear edges, grooves for directing raindrops sidewardly, or downwardly extending portions at the front and rear edges.

Frame member 16 is an inverted, U-shaped tubular member. A single cross element 32 extends between downwardly extending legs 34. Frame member 16 may be formed from a single piece of stock, or it may have angle connectors 36 at corner intersections between cross element 32 and a leg 34. Frame member 16 is preferably made from PVC tubing.

As shown in FIGS. 3–5, clamp mechanism 18 includes a bearing plate 38 held between a retainer plate 40 and the end of a leg 34 by a nut and bolt combination 43,42. Retainer plate 40 holds against bearing plate 38 a pair of yieldable members 44 having clamp members 46 extending between leg ends of the yieldable members 44. Each yieldable member 44, as most clearly seen in FIG. 5, is preferably made as a shaped wire having a connecting arm 48 between a pair of U-shaped ends 50. Ends 50 have base 52 angularly converging toward one another. A leg 54 of ends 50 connects bases 52 with connecting arm 48. The other leg 56 of ends 50 is open for insertion in openings 58 located centrally in the ends of clamp members 46.

Bearing plate 40 includes two spaced-apart, approximately parallel grooves 60 on its side which contacts bearing plate 38. Each groove receives a connecting arm 48 of a yieldable member 44 in order to hold yieldable members 44 between retainer plate 40 and bearing plate 38. Retainer plate 40 is ordinarily rectangular. Retainer plate 40 includes an opening for passage of bolt 42 which is countersunk on its side opposite bearing plate 38 in order to provide for space for nut 43 so that nut 43 does not extend beyond the outer surface 62 of retainer plate 40. In that fashion, the clamped frame member of a chair 12 is held between clamp members 46 and surface 62 without contacting nut 43 thereby avoiding possible scratching.

Clamp members 46 are preferably cylindrical so they may rotate as they expand and move about a particular frame member while proceeding from one side of the frame member to the other in moving from an unclamped configuration to a clamped configuration.

Bearing plate 38 is preferably made from a synthetic material so that bolt 42 and nut 43 may be firmly fastened without frequent retightening while still allowing frame member 16 to rotate about bolt 42. As indicated hereinbefore, this is possible due to the low coefficient of friction between a pair of synthetic materials. It is preferable to tighten bolt 42 and nut 43 sufficiently tight to slightly deform tube 34 of frame member 16. Such deformation acts to keep the nut and bolt combination tight. Yet, because of the low coefficient of friction between frame member 16 and bearing member 38, such tightness does not prevent angular adjustment of frame member 16 with respect to clamp mechanism 18.

To use, chair 12 is unfolded. Clamp mechanisms 18 are pushed over opposite frame members of chair 12 and apparatus 10 is firstly adjusted at the ends of frame member 16 by grasping one or both of legs 34 and rotating them about bolts 42 and secondly adjusted by grasping shade member 14 and rotating it about screws 28.

More particularly, when a clamp member 18 is pushed onto the frame member of chair 12, clamp elements 46 roll and yieldably separate to receive the frame member between the clamp members 46 and retainer plate 40. The torsion spring constant of yieldable members 44 at each end 50 provides the necessary force for the clamping relationship.

The adjustment of legs 34 of frame member 16 occurs as a result of a simple rotation of legs 34 about bolts 42 with legs 34 easily sliding across the surface of bearing member 38. If desired, a small washer of preferably synthetic material may be installed between the head of bolt 42 and leg 34.

The adjustment of shade member 14 is easily accomplished by simply grasping the front or rear of shade member 14 and moving upwardly or downwardly about screws 28. The downwardly extending portions 26 easily slide between washers 30 and frame member 16.

Figure 6:
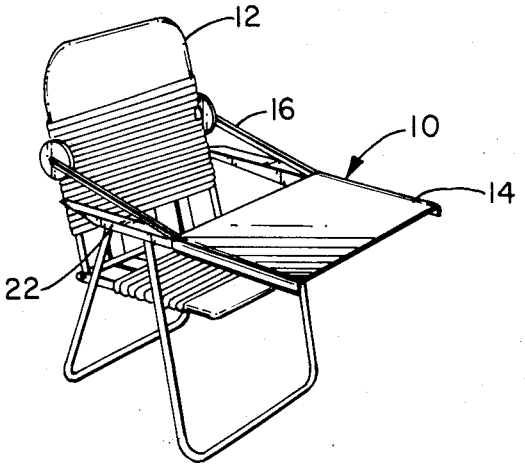
FIG. 6 is a perspective view of apparatus in accordance with the present invention shown in a position for use as a tray for the chair to which it is attached.

The present invention has utility not only in a shade position as shown in FIG. 1, but also in a position wherein frame member 16 is rotated forwardly 90 degrees or more and the flat shade member 14 is rotated counterclockwise as viewed in FIG. 6 to be substantially parallel with the plane of the U-shaped frame member 16. In this position, shade member 10 becomes a tray for the person sitting in chair 12. Frame member 16 is supported from further downward rotation by the arm rests 22 of chair 12 or by resting shade member 14 or frame member 16 on the legs of the person sitting in chair 12.

Figure 7:
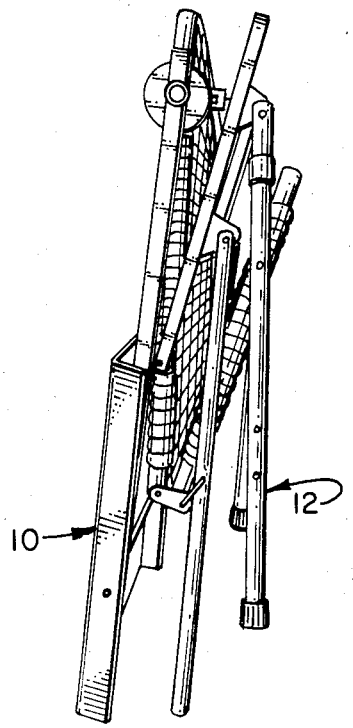
FIG. 7 is a perspective view of the chair of FIG. 6 in a folded position with the apparatus of the present invention positioned for stowage with the chair.

By rotating frame member 16 rearwardly with respect to chair 12, and rotating shade member 14 into a position approximately parallel with frame member 16, apparatus 10 may be placed neatly against the back of chair 12 for storage. In this position, chair 12 may continue to be used in the usual fashion. Also, as shown in FIG. 7, chair 12 may be folded and neatly stowed in combination with apparatus 10.

Figure 8:
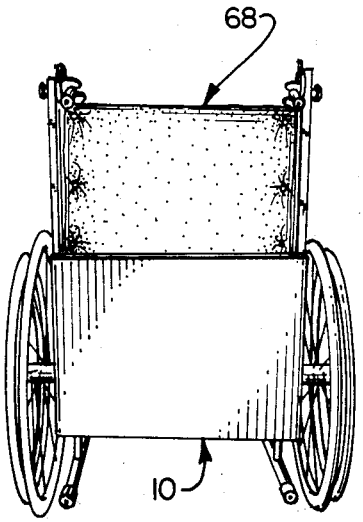
FIG. 8 is a rear elevational view of a wheelchair with the apparatus of the present invention attached and located in the stowage position.

In FIG. 8, apparatus 10 is shown as attached to a wheelchair 68. With respect to wheelchair 68, apparatus 10 may also be placed in any of the indicated positions, that is, the shade position of FIG. 1, the tray position of FIG. 6, or a storage position as shown in FIG. 8.

An alternate embodiment of clamp mechanism 18 is shown in FIGS. 9–12, wherein the same reference numerals, only primed, designate identical parts in as compared with the embodiment of the previous figures. Clamp mechanism 18' includes first and second clamp elements 70 and 72. Clamp element 70 is attached with bolt 42' to leg 34' of frame member 16' with bearing plate 38' therebetween. A threaded knob 74 is threaded onto the end of bolt 42' to hold the various parts in place.

Clamp element 70 includes a base portion 76 and a jaw portion 78. Base portion 76 includes a central core 80 in the form of a channel having the open side of the channel facing bearing plate 38'. Core 80 includes a centrally located boss 82 having a passage therethrough for receiving bolt 42'. A rail 84 is spaced outwardly from each side of core 80 and attached thereto by neck 86. The bottom surface 88 of a rail 84 extends slightly beyond the wall edges of core 80 so that clamp element 70 contacts bearing plate 38' at bottom surfaces 88 of rails 84. The upper surface 90 and groove 92 above neck 86 provides support and retention for clamp element 72 as described hereinafter.

Clamp element 72 also includes a base portion 94 and a jaw portion 96. Base portion 94 includes side walls 98 connected at one end by jaw portion 96 and at the other end by an end wall 100. A top 102 extends inwardly form each wall to near core 80 of clamp element 70 when elements 70 and 72 are interconnected. A short inner wall 104 along a portion of top 102 extends downwardly from the inner edge of top 102 into groove 92. With inner wall 104 and top 102 coacting with rails 84, sidewalls 98 extend downwardly to approximately the plane in which bottom surfaces 88 lie so that bottom edges 106 of walls 98 support clamp element 72 against bearing plate 38'.

Figure 9:
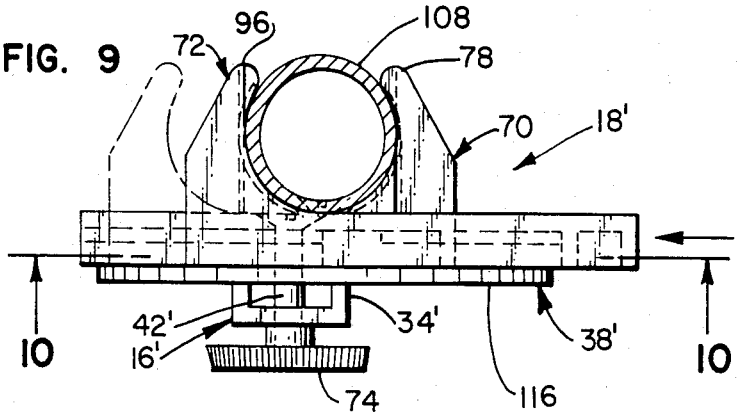
FIG. 9 is a top plan view of an alternate embodiment of the clamp device in accordance with the present invention, showing the tubular frame member in cross section.
Figure 10:
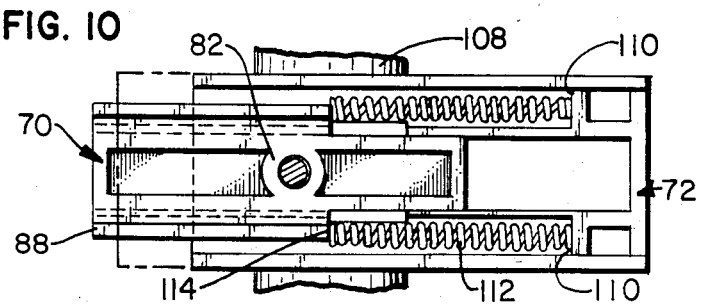
FIG. 10 is an end a cross-sectional view taken generally along line 10—10 of FIG. 9.
Figure 11:
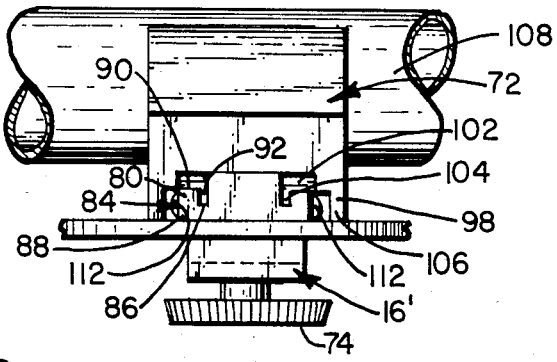
FIG. 11 is an end elevational view of the device of FIG. 9.
Figure 12:
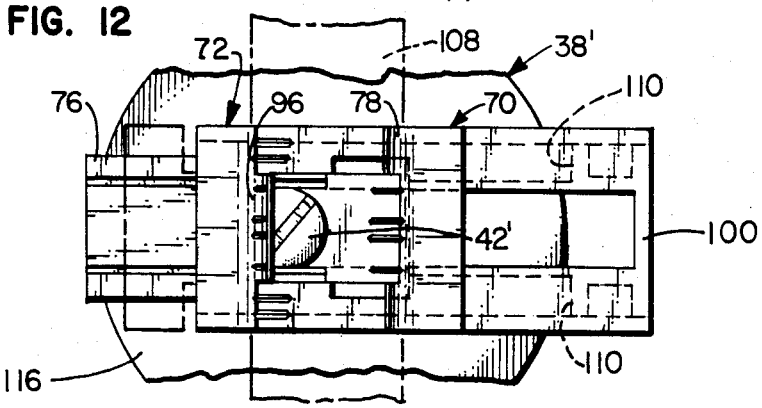
FIG. 12 is a side elevational view of the device of FIG. 9.

Clamp elements 70 and 72 are interlocked together so that the tops and inner walls of base portion 94 of clamp element 72 slide on rails 84 of clamp element 70. Clamp elements 70 and 72 are arranged such that jaw portion 78 is between jaw portion 96 and end wall 100 of clamp element 72. Jaw portions 96 and 78 may have any of a variety of shapes, but when intended for receiving a cylindrical member 108 as shown in FIG. 9, it is preferable for jaw members 72 and 96 to have arcuate surfaces which substantially mate with and receive member 108.

Clamp elements 70 and 72 are biased so that jaw portions 78 and 96 close or clamp against member 108. Clamp element 72 includes barriers 110 spaced apart from end wall 100 and extending between the outer walls 98 and inner walls 104. Coil springs 112 are located between barriers 110 of clamp element 72 and ends 114 of rails 84 of clamp element 70. Since clamp element 70 is attached with bolt 42' to frame member 16', clamp element 72 may be pushed at end wall 100 toward clamp element 70 to compress springs 112 and separate jaw portions 78 and 96 for releasing held cylindrical member 108.

As indicated, clamp element 70 is attached with preferably a flat headed screw or bolt 42' to frame member 16' with bearing plate 38' therebetween. Threaded knob 74 threads onto bolt 42' to hold the parts. Bearing plate 38' is preferably a disk of diameter sufficient to contain coil springs 112. Preferably the end of clamp element 72 which includes wall 100 extends somewhat beyond bearing plate 38' so that wall 100 may be easily pushed to slide clamp element 72 with respect to clamp element 70. Knob 74 is preferably of sufficient size to easily grasp and turn to loosen or tighten onto bolt 42'. Bearing plate 32' provides a surface on both sides along which either frame member 16' or clamp elements 70 and 72 may easily rotate with respect to the other.

In some circumstances, it is preferably to include radial detents in surface 116 of bearing plate 38' for receiving frame member 16' to locate it for particular positions as shown in FIGS. 1 and 6–8.

In use, clamp mechanism 18' of the alternate embodiment is clamped on the opposite sides of the frame of the back of a chair or on the arm rests or some similar member. Jaw portions 78 and 96 are separated as shown in the broken lines of FIG. 9 by pushing in the direction of the arrow on wall 100 of clamp element 72. When the particular member, for example, cylindrical member 108 is positioned between jaw portion 78 and 96, wall 100 is released and springs 112 force jaw portion 96 toward jaw portion 78 to provide the appropriate clamping force. Frame member 16' and shade member 14 are pivoted then as appropriate to position apparatus 10 as desired, for example, in the shade position of FIG. 1, the tray position of FIG. 6, or in the storage position of FIGS. 7 and 8. It is noted that member 14 is often flat on top and may even have upward extending ridges around its periphery in order to be mroe usable as a tray. After frame member 16' has been pivoted to a desired orientation, knob 74 is tightened to hold the desired orientation.

Thus, the various advantages of the invention, as well as the details of structure and function have been set forth in detail. Nevertheless, it is understood that the disclosure is illustrative only. Therefore, changes made, especially in matters of shape, size and arrangement, to the full extent extended by the general meaning of the terms in which the appended claims are expressed, are within the principle of the present invention.

What is claimed is:

1. Sun shade apparatus for a chair, comprising:

a frame;

a member for providing shade;

first means for attaching said shadeproviding member to said frame;

clamp means for pivotally holding said frame to said chair, said clamp means including first and second clamp elements, said clamp means further including a bearing member and second means for pivotally attaching together said first clamp element, said bearing member and said frame, said first clamp element including means for retaining said second clamp element against said bearing member, said retaining means including means for moving said second clamp element linearly with respect to said first clamp element to releasably clamp said chair between said first and second clamp elements;

whereby said apparatus is adjustable at said first and second attaching means and said clamp means is clamped to and released from said chair by operating said moving means.

2. Apparatus in accorance with claim 1 wherein said moving means includes means for biasing said first and second clamp elements toward the clamped position.

3. Apparatus in accordance with claim 2 wherein said moving means includes a rail member on both opposite sides of one of said first and second clamp elements and a right angle wall on both opposite sides of the other of said first and second clamp elements for sliding on said rails, whereby said first and second clamp elements may be slid with respect to one another to move between clamped and unclamped positions.

4. Apparatus in accordance with claim 3 wherein said bias means includes a coil spring, said spring retained between an end of said rail on said one of said first and second clamp elements and a wall on the other of said first and second clamp elements, said spring further retained between at least one of said first and second clamp elements and said bearing plate, whereby said bearing plate serves as an enclosing wall for said spring.

5. Sun shade apparatus for a chair, comprising:

a frame;

a member for providing shade;

first means for attaching said shadeproviding member to said frame; and clamp means for pivotally holding said frame to said chair, said clamp means including;

a first clamp element having a first base portion and a first jaw portion;

a second clamp element having a second base portion and a second jaw portion;

means for interconnecting said first and second clamp elements together, said interconnecting means including means for linearly moving said first and second jaw portions with respect to one another;

a bearing plate; and second means for pivotally attaching together said first base portion of said first clamp element, said bearing plate, and said frame, said interconnecting means retaining said second base portion against said bearing plate, whereby said first and second clamp elements may pivot on said bearing plate with respect to said frame.

6. Sun shade apparatus for a chair, comprising:

an inverted, U-shaped, tubular frame member, said frame member having a cross element between legs;

a substantially flat member for providing shade, said cross element supporting said flat member;

first means for pivotally attaching said flat member to said frame member; and a pair of clamp means for holding said frame member to said chair, each of said clamp means including first and second clamp elements, each of said clamp means further including means for moving said flat member between a first position for shading said chair, a second position for providing a tray table for a person in said chair, and a third position wherein said chair has a back and said flat member is substantially parallel to the back of said chair for storing with respect to said chair, each of said moving means including a bearing plate and means for fastening together said first clamp element, said bearing plate, and one of the legs of said frame member, said second clamp element retained between said first clamp element and said bearing plate, whereby said legs of said frame member may pivot on said bearing plate with respect to said clamp elements and said flat member may be moved at said first attaching means between said first, second and third positions.

* * * * *